US005996971A

United States Patent [19]

Crouse

[11] Patent Number: 5,996,971

[45] Date of Patent: Dec. 7, 1999

[54] WELL PIPE HOIST AND HOISTING METHOD

[76] Inventor: Gerald Crouse, 129 Westmoreland St., Fredericton, N.B., Canada, E3B 3L4

[21] Appl. No.: 07/925,790

[22] Filed: Aug. 7, 1992

Related U.S. Application Data

[63] Continuation-in-part of application No. 07/601,497, Oct. 23, 1990, abandoned.

[51] Int. Cl.[6] ..... B66D 1/30

[52] U.S. Cl. ..... 254/371; 254/362; 254/380; 254/382

[58] Field of Search ..... 254/266, 371, 254/372, 382, 362, 342, 380; 226/190, 168, 188, 172; 166/377, 380, 85

[56] References Cited

U.S. PATENT DOCUMENTS

| | | | |
|---|---|---|---|
| 178,854 | 6/1876 | Hyde | 254/266 |
| 1,397,937 | 11/1921 | Spencer | 254/380 |
| 2,670,926 | 3/1954 | Sewell et al. | 226/186 |
| 3,168,287 | 2/1965 | Parola | 254/330 |
| 3,635,441 | 1/1972 | Haines | 254/371 |
| 3,741,525 | 6/1973 | Smedley | 254/266 |
| 3,791,625 | 2/1974 | Viljoen | 226/183 |
| 3,809,366 | 5/1974 | Crees | 226/168 |
| 3,871,618 | 3/1975 | Funk | 226/187 |
| 4,290,584 | 9/1981 | Eckels et al. | 254/380 |
| 4,296,916 | 10/1981 | Jewett | 254/380 |
| 4,314,693 | 2/1982 | Hobbs | 254/376 |
| 4,445,668 | 5/1984 | Sauber | 254/287 |
| 4,655,291 | 4/1987 | Cox | 166/385 |
| 4,695,040 | 9/1987 | Hantschk | 254/264 |
| 4,971,293 | 11/1990 | Roberson, Jr. | 254/265 |

FOREIGN PATENT DOCUMENTS

| | | | |
|---|---|---|---|
| 5651 | 3/1897 | Norway | 254/287 |
| 51390 | 1/1931 | Norway | 254/371 |

*Primary Examiner*—Katherine A. Matecki

[57] ABSTRACT

A portable apparatus for pulling well pipe upwardly through a well includes a well pipe hauling head which incorporates two opposed, inwardly tapering discs which are adapted to frictionally engage well pipe therein by only a quarter-turn engagement with the pipe. This allows for easy manual engagement and disengagement of the well pipe with the hauling head. The hauler head is mounted with suitable mounting apparatus permitting the hauler head to be freely rotatable in a supported position adjacent a well. The apparatus may be provided with a reduction gear box so that it may be actuated by a portable power drill.

9 Claims, 7 Drawing Sheets

WELL PIPE HOIST AND HOISTING METHOD

This application is a Continuation-in-Part of U.S. Ser. No. 07/601,497 filed Oct. 23, 1990, now abandoned.

FIELD OF THE INVENTION

This invention relates to a well apparatus. More particularly it relates to a portable apparatus adapted to pull well pipe upwardly from within a well.

BACKGROUND TO THE INVENTION

In wells including submersible pumps for pumping water up through long flexible plastic tubing (hereafter "well pipe"), pipe, removal of the well pipe is difficult as this procedure is labour intensive and time consuming. Traditional well management systems can be employed to achieve this result, e.g. a tower crane. This, however, is a costly proposition.

Various other attempts to manage the hoisting of well pipe have been made in the art such as that disclosed in U.S. Pat. No. 4,655,291. In this document, Cox discloses an apparatus for running pipe into or out of a well. The apparatus includes a dual roller system with a complicated network of springs, gears, chains, etc. The apparatus of this invention, since it includes numerous moving parts is susceptible to wear etc., which limits its usefulness.

In Canadian Patent No. 695,744, there is disclosed an apparatus for delivering pipe to a well which includes a spool carrying relatively inflexible well pipe to be fed into or removed from a well. This is done using a first feed-wheel which cooperates with a series of smaller straightening wheels which act as straightening rollers to deliver the pipe into the well in a linear condition. This same apparatus is said to also permit retrieval of well pipe.

Other patent documents related to the field of this invention include the following U.S. Pat. Nos. 3,168,287; 2,670,926; 3,809,366; 3,871,618; 4,296,916 and 3,791,625.

In Parola (U.S. Pat. No. 3,168,287) flexible well pipe is wound around a pulling drum several turns in order to lift the pipe from the well. The well pipe is grasped by the radial constrictive force caused by the encirclement of the cylindrical core of the drum by the pipe.

In Sewell (U.S. Pat. No. 2,670,926) flexible cable is drawn-in by a pair of opposed pneumatic tires that pinch the cable between the flat cylindrical faces of the two tires. The cable is fed straight through the "pinch" created by the two tires.

In Funk (U.S. Pat. No. 3,871,618) three obliquely opposed tires are used to pull well pipe in the manner of Sewell.

In Crees (U.S. Pat. No. 3,809,366) flexible electrical cable is fed by frictional engagement over a grooved spool or pulley into conduit. This pulley is shown in one embodiment (FIG. 2) as having an "arcuate" end or groove (44) for engagement of the conduit. Additional frictional engagement with the conduit is said to be effected in another embodiment (FIG. 3) by helically wrapping the conduit around the pulley for several turns. The embodiment of FIG. 1 shows a half-turn engagement between the conduit and pulley, enforced by the presence of a protective casing cover (21).

In Jewett (U.S. Pat. No. 4,296,916) a cable-carrying winch is shown mounted at a well-head for lifting a submersible well pump from the well bottom by cable.

Viljoen (U.S. Pat. No. 3,791,625) is a patent directed to hauling fish nets from the water. A powered V-shaped sheave in conjunction with a constant-pressure wheel is used to shape the net to resist shearing of the netting strands. The sheave surface is shown as being purely conical or "V"-shaped in cross-section in the region where it engages with the net.

The present invention addresses the problem of providing a hoisting mechanism for pulling from a well a length of flexible well pipe utilizing a hoisting system that allows the operator to readily engage, and disengage, the pipe as required during the well pipe removal operation. This is effected by a pipe-engaging mechanism that differs from the prior art both as to its structure and in the convenience of its use.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The present invention according to one aspect provides a portable apparatus for the raising of flexible well pipe from a well by means of a well pipe hoisting means that incorporates a pair of opposed convex surfaces to grasp and lift the pipe.

A preferred aspect of the present invention provides a portable apparatus for pulling flexible well pipe upwardly from within a well, comprising:

(1) well pipe hauling means incorporating opposed convex, pipe engaging surfaces for frictionally engaging to flexible well pipe extending outwardly from a well;

(2) actuation means for rotationally actuating the hauling means in order to hoist the well pipe from the well; and (3) mounting means for mounting the hauling means and the actuation means over the well whereby the well pipe may be frictionally engaged and pulled upwardly by the hauling means upon actuation of the actuation means.

In a further preferred aspect of the present invention the opposed, convex, pipe-engaging surfaces of the hauling means are rotatably mounted between spaced apart support members about an axle extending therethrough.

More particularly, in one configuration the invention comprises a portable apparatus for pulling flexible well pipe upwardly from within a well comprising, in combination with a well and well pipe contained therein:

(a) well pipe hoisting means for receiving and frictionally engaging the well pipe, the hoisting means being rotatable about an axle mounted perpendicularly to the well pipe while the well pipe is engaged within the hauling means;

(b) actuation means for actuating the hoisting means and connected therewith; and (c) mounting means for mounting the hoisting means and actuation means above a well, wherein the hoisting means comprises a pair of rotatable disc members mounted on the axle and joined to such axle at their inner portions, each of these disc members having a mutually opposed, convex, pipe-engaging surface spaced one from the other to provide a gap therebetween, the gap tapering from the outer periphery of such disc members towards the axle from a separation that is greater than the width of the well pipe to a separation that is less than the width of the well pipe whereby the well pipe may be frictionally engaged between the convex, pipe-engaging surfaces and pulled upwardly by the hoisting means upon actuation of the actuation means.

The apparatus further includes mounting means which, in one form, can be attached to a well-head collar member or a well casing by the use of brackets etc.

In alternate embodiments, the mounting means of the present invention may support the hauling apparatus on the ground about the periphery of a well by means of a stand. Or, in applications where the well is within an excavated pit, supports associated with the mounting means may be forced into the ground about the well. Depending on the depth of the pit surrounding a well, the mounting means may include coupling means to join support extensions of the mounting means. Additionally, the actuation means to effect rotation of the hauling means may include a reduction gear box which is actuatable by a portable drive means such as a battery-powered hand drill.

Typically, the hauling means and mounting means may be composed of any suitable rigid materials, for example, suitable resinous materials, e.g. ABS, PVC; or metals, e.g. aluminum, steel, etc.

According to an alternate variation of the invention, a portable well pipe pulling apparatus is provided which comprises:

(1) well pipe hoisting means incorporating exposed, circular, inwardly tapering, rotatable, pipe engaging surfaces that are frictionally engaged to flexible well pipe extending outwardly from a well;

(2) actuation means for rotationally actuating the pipe-engaging surfaces in order to hoist the well pipe from the well; and (3) mounting means for mounting the hoisting means and the actuation means over the well whereby the well pipe may be manually laid over and frictionally engaged with the pipe-engaging surfaces by contact over a portion of the pipe-engaging surfaces that corresponds to one-quarter of a rotation of such surfaces, or less; and disengaged from such surfaces by manually lifting the well pipe from a portion of the pipe-engaging surfaces.

This invention also extends to the method of utilizing the well pipe pulling apparatus in the manner as last described.

The foregoing summarizes the principal features of the invention. The invention, together with further features thereof, may be further understood by the description of the preferred embodiments, in conjunction with the drawings, which now follow.

DESCRIPTION OF THE PREFERRED EMBODIMENTS

Figure 1:
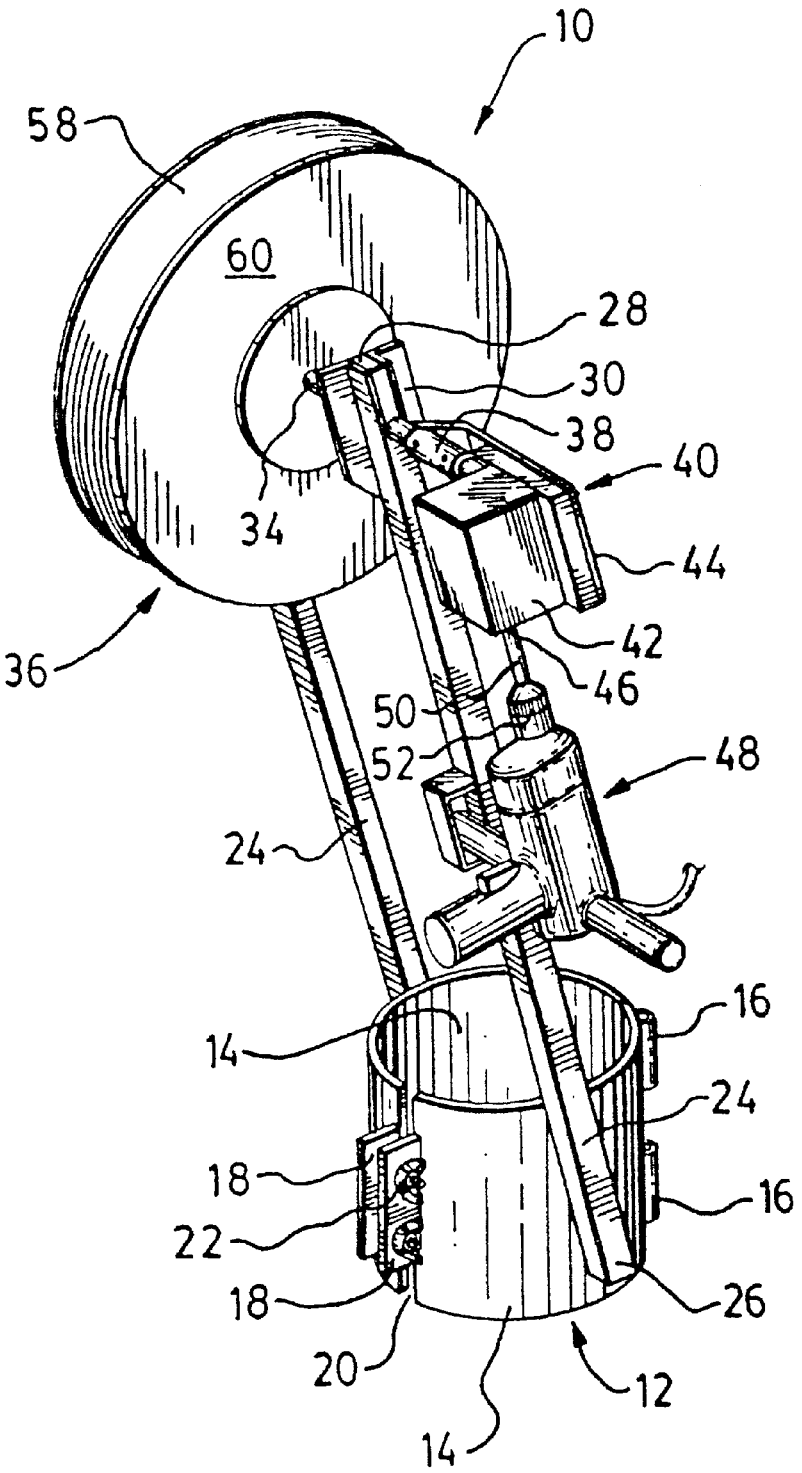
FIG. 1 is a perspective view of ore embodiment of the present invention mounted directly on a well head.

Referring to FIG. 1, there is shown a perspective view of the apparatus of the present invention generally indicated by numeral 10.

The apparatus 10 includes a collar member 12 preferably comprising a pair of cylindrical sleeves 14 hingedly connected at hinges 16. On an opposed side of the cylindrical sleeves 14 there is an outwardly projecting member 18 associated with each sleeve 14. The projections 18 each include a plurality of spaced apart apertures 20 therethrough which register in alignment when the sleeves 14 are in a closed i.e. facing relation (FIG. 1). The collar 12 may be thus releasably engaged to a well casing (not shown) by tightening suitable fastening means, for example, wing nuts 22 within the apertures 20. Although the cylindrical and hingedly connected sleeves 14 have been described for the collar 12, any arrangements of components which provide releasable and frictional contact by compressive force about a well casing is contemplated. By one variation, for example, the sleeves 14 may be independent and each include conventional clamps etc.

Intermediate of the hinges 16 and projections 20 on the outside of each sleeve 14, there is included an elongated upwardly projecting support member 24. Each of the support members 24 include opposed ends 26, 28 and are preferably manufactured of a suitable rigid and substantially inflexible material e.g. aluminum, steel, etc. A portion of the supports 24, proximate the lower opposed ends 26 thereof, are preferably attached to the collar 12, i.e. one on each sleeve, either by permanent means e.g. welding or by temporary means e.g. nuts and bolts, slots on each sleeve to receive the lower portion of a support etc. The choice of the means employed to attach the supports to the sleeves will not adversely impede the functioning of the apparatus.

Proximate the opposed end 28 of each support 24 there is included a U-shaped guide and support member 30 which cooperates with the apertures 32 extending through the supports 24 proximate the ends 28 thereof. The apertures 32 and guide members 30 receive arid support axle 34 of the hauling means 36, also referenced as hoisting means 36, which is pendicularly mounted therein. The axle 34 of the hauling means 36 is preferably freely rotatable within the apertures 32 of the supports by incorporating bearing means e.g. ball or journal bearings etc. therein. The axle 34 extends slightly beyond and outwardly from at least one of the supports 24 and includes a coupling member 38 to couple the axle with the actuation means 40.

The actuation means 40, as shown in one form, includes a gear box 42 releasably and slidably mounted on a supporting plate 44, which is fixedly secured proximate the end 28 of support 24. The gear box 42 preferably includes an opening 46 which facilitates communication between the gear box 42 and drive means, e.g. a hand drill 48, via a suitable gear turning member 50. In the case where a cordless or battery-powered hand drill is employed as a drive means the gear box 42 should be a reduction gear box. The gear turning member 50 may be inserted into the chuck 52 of the drill and subsequently into the opening 46 of the gear box 42. It is preferred that at least one support member 24 include means 54 to releasably hold the drive means 48 while in use. The holding means 54 can comprise, for example, a slot to hole a handle 56 of the drill 48 or, in other forms, a bracket, clamp, etc.

Figure 3:
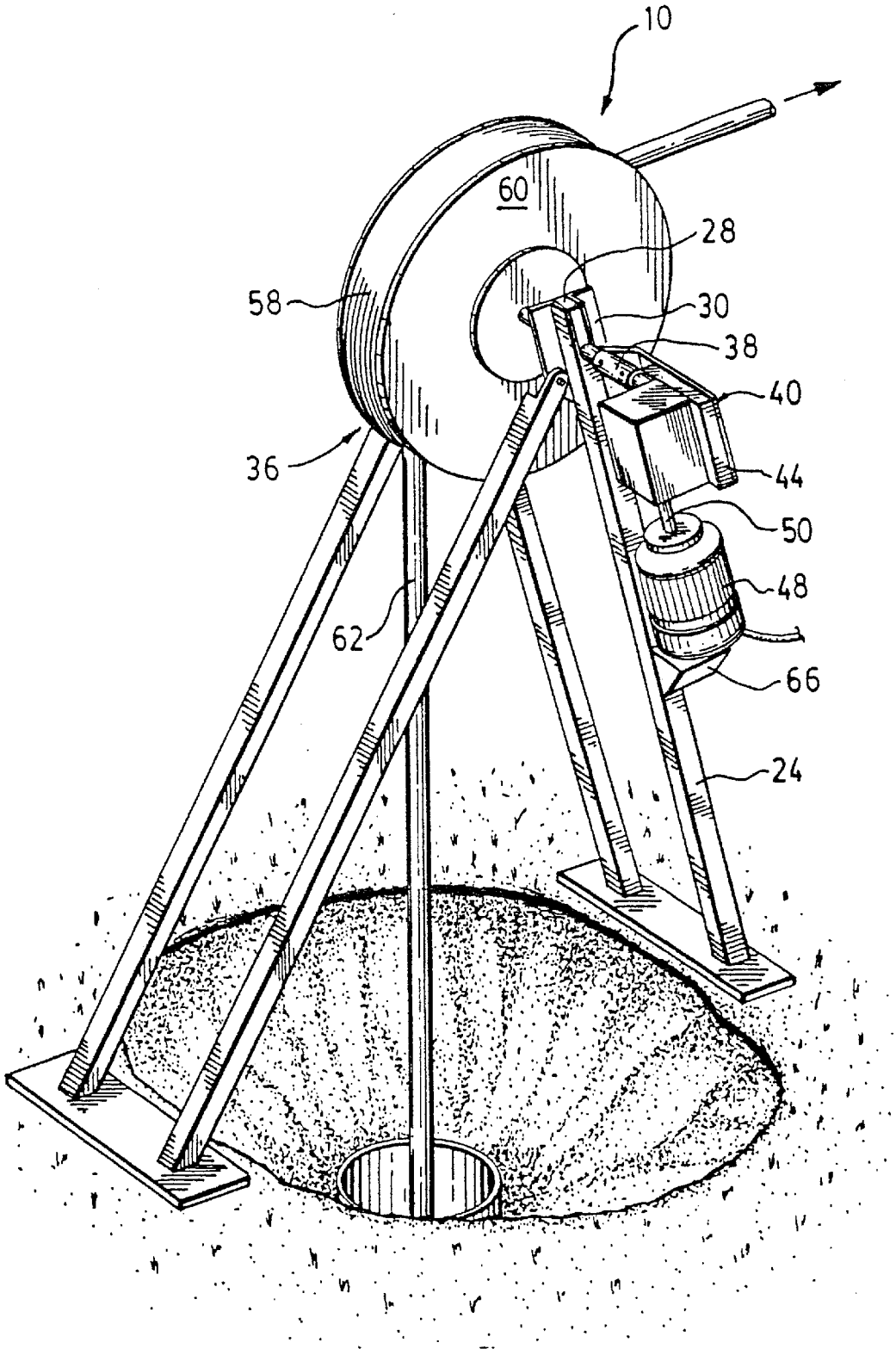
FIG. 3 is a perspective view of an alternate embodiment of the present invention mounted on a stand abridging a well-head set within a pit.

In another embodiment, such as that shown in FIG. 3, the support 24 may be placed firmly in the ground as an alternative to using the collar member shown in FIG. 1. This arrangement is particularly useful for wells which are flush i.e. contiguous with the ground level. In addition, the drive means 48 of FIG. 1 may be easily replaced with other drive means, for example, a conventional motor, which could be held in place by a bracket 60 secured to support 24.

Figure 4:
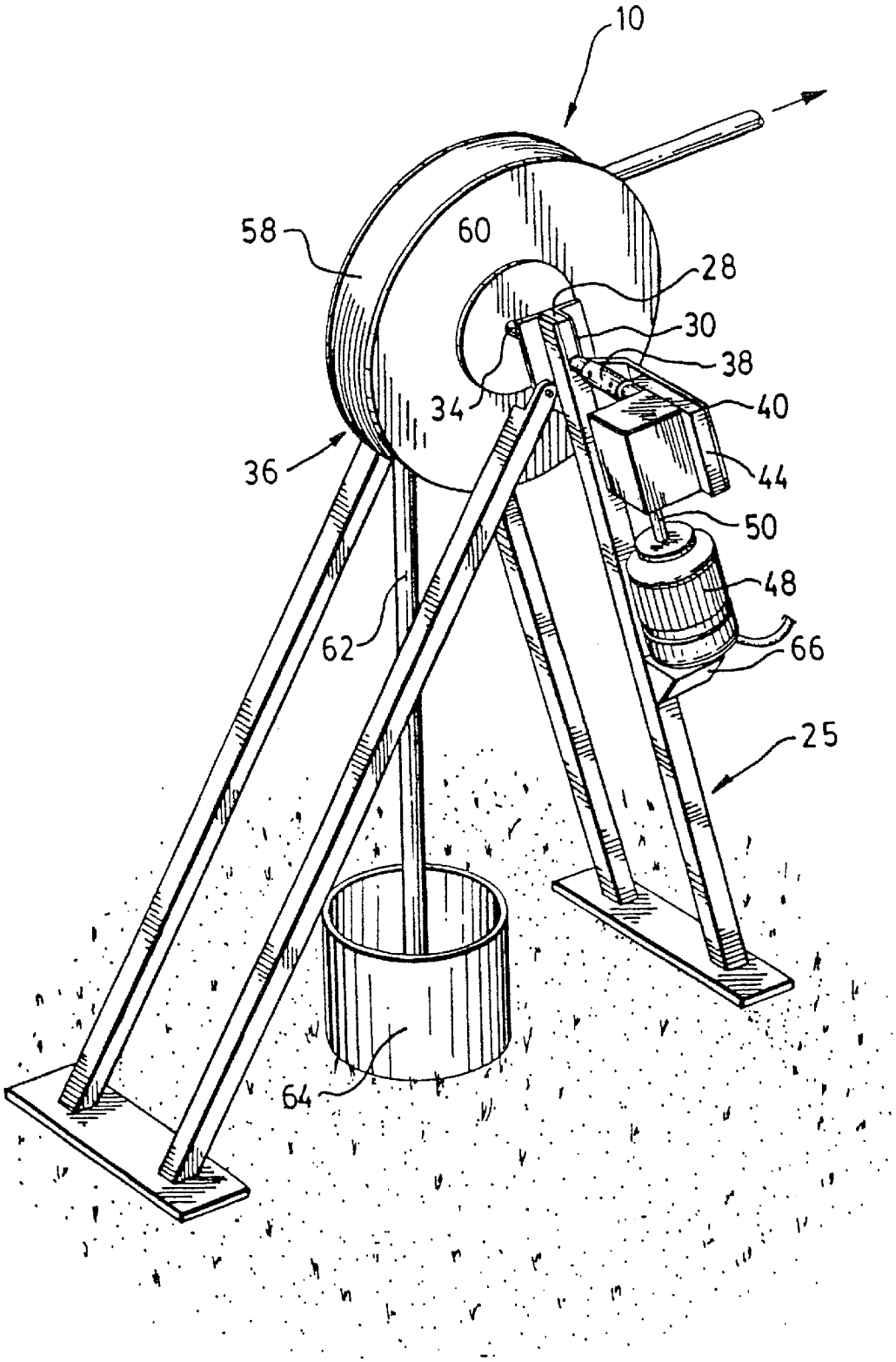
FIG. 4 is a perspective view of yet another embodiment of the present invention set above a well-head at ground level.

In yet another embodiment as illustrated in FIG. 4, the apparatus may include free standing supports 24 to position the apparatus 10 over a well.

Figure 5:
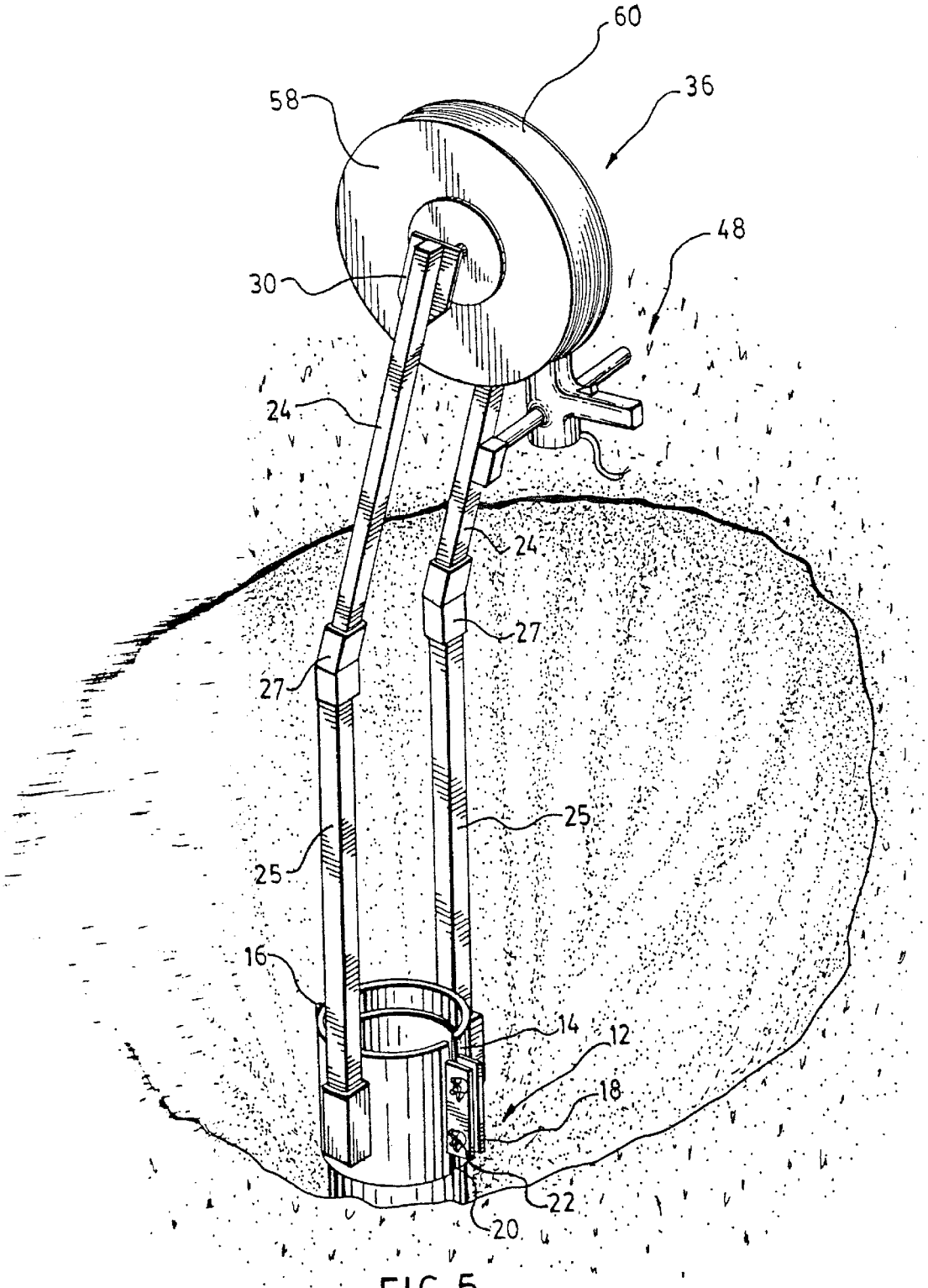
FIG. 5 is a perspective view of a further embodiment showing a further means for mounting the present invention to a well-head.

In a further embodiment as shown in FIG. 5, the apparatus may be easily adapted for situations where the well is recessed from the surface of the ground, i.e. within an excavated pit. In such an application, the length of supports 24 may be augmented by ancillary support extensions 25 of sufficient length to facilitate convenient access to the apparatus.

Additionally, the ancillary supports 25 will preferably be coupled to supports 24 by coupling means 27 e.g. sleeves which are preferably slightly larger in cross-sectional area than that of the supports 24, 25 in order to receive the same therein. The coupling means 27 may be angled to further provide convenient access to the apparatus for a user.

Considering the hauling means 36, it is particularly preferred that the hauling means 36 comprises a pair of rigid rotatable discs 58, 60 that are generally hemispherical or circular in cross-section and in juxtaposed relation at the convex surfaces thereof. In such an arrangement, the discs 58 and 60 present inwardly tapering surfaces 58*a*, 60*a* adapted to receive a well pipe 62 therebetween. This is more clearly illustrated in FIG. 2.

The inwardly tapering surfaces 58*a*, 60*a* formed on the discs 58 and 60, which according to one preferred embodiment are convex in shape, frictionally engage the well pipe 62 to enable hauling of pipe from a great depth within the well 64. The curvature of such surfaces need not be perfectly circular. They are preferably convex but may, in a simplified form, merely be inwardly tapered as further described below. To further enhance the grip of the discs 58 and 60, each may include a textured inner surface.

Figure 6:
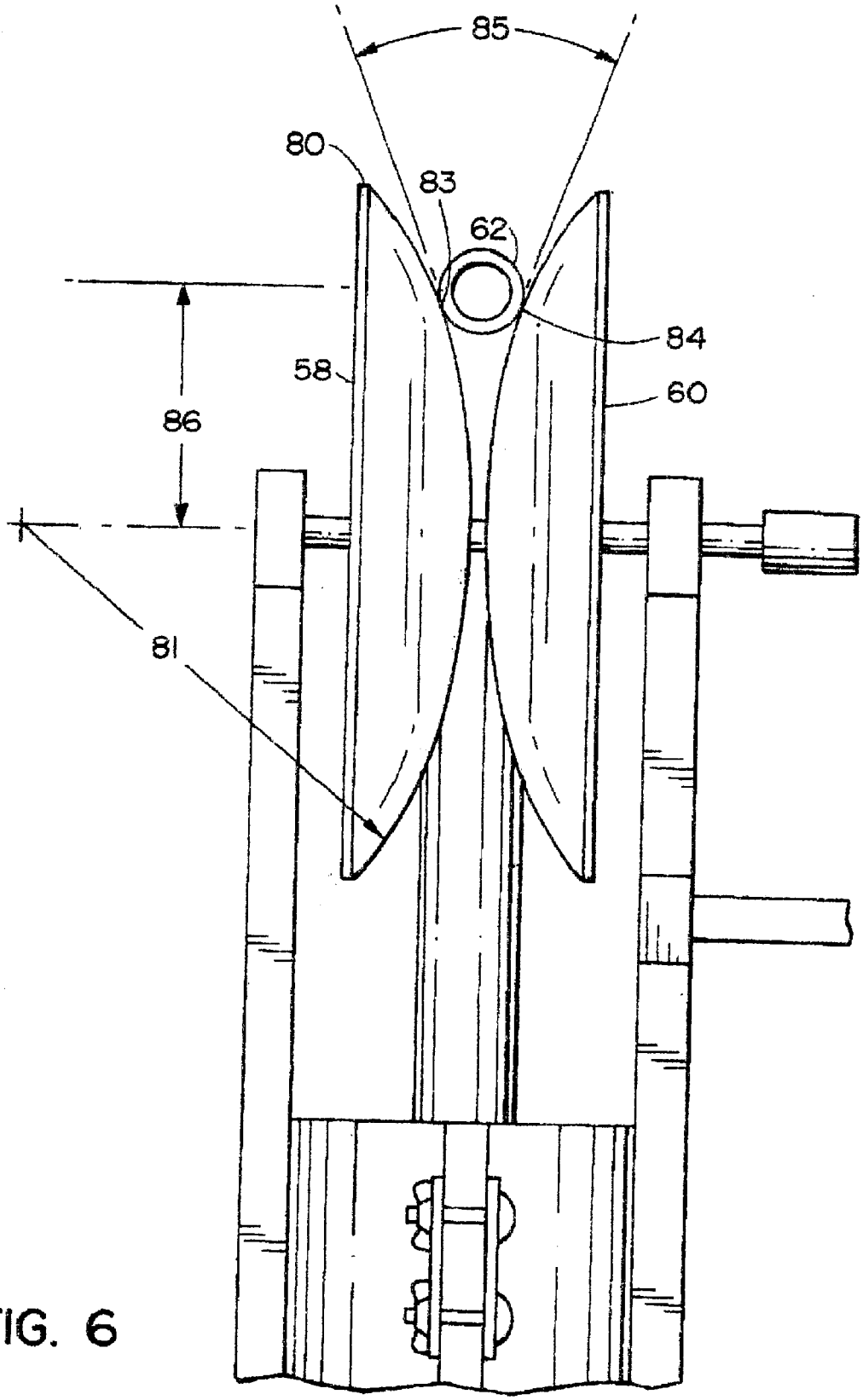
FIG. 6 is an enlarged view showing the engagement of well pipe between the inwardly tapering discs that form an aspect of the invention.

The manner by which well pipe is grasped between the pipe-engaging surfaces 58*a*, 60*a* of the discs 50, 60, is best shown in FIG. 6. In this Figure it will be seen that the pipe 62 contacts the surfaces 58*a*, 60*a* at contact points 83,84. These contact points determine a wedging angle 85 that occurs at a contact radius 86 extending outwardly from the axle 34.

The key feature is that the surface friction and wedging angle 85 should allow the discs 58, 60 to grasp the pipe 62 frictionally when the pipe is wrapped between the discs 58, 60 to an extent which approximates 90 degrees of rotation. For this purpose the discs 58, 60 must present surfaces 58*a*, 60*a* that provide a gap therebetween that tapers from the outer periphery 80 of the discs 58, 60 towards the axle 34 from a separation that is greater than the width of the well pipe 62, to a separation that is less.

It has been found that with one inch diameter well pipe 62, adequate engagement occurs at a contact radius 86 of 5½ inches, and a wedging angle about 28 degrees. This is with discs 58, 60 that have a local radius of curvature 81 of about 22½ inches at the contact points 83, 84.

For 1½ and 2 inch pipe, full engagement occurs at a contact radius 86 of about 6 3/16 and 6 4/16 inches respectively, both having wedging angles 85 of around 34 degrees. Some variability arises from the use of polyethylene as a material for the pipe 62, as this material deforms somewhat on engagement with the discs 58, 60.

For a pipe diameter of 1.75 inches a wedging angle 85 of 47 degrees, corresponding to a radius of curvature 81 of 9.7 inches, has been found to be too large. Discs with a radius of curvature 81 of 22.4 inches provide a satisfactory wedging angle 85 of 32 degrees. An optimal disc radius for the foregoing range of polyethelene pipe is believed to be about 16 inches.

Figure 7:
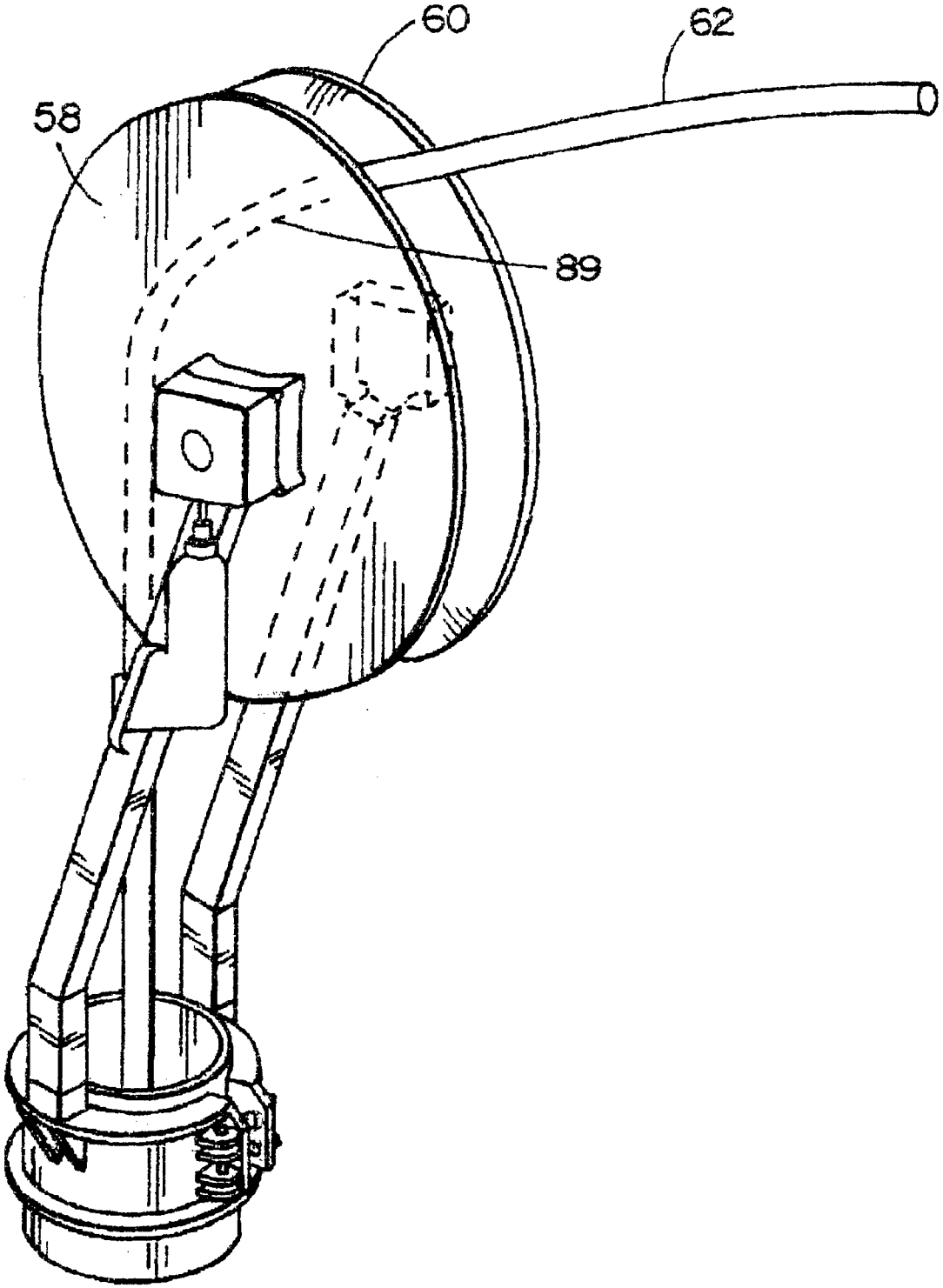
FIG. 7 is a perspective view showing the engagement of the well pipe with the discs of FIG. 6.

As best shown in FIG. 7, the ability to engage with the pipe 62 by approximately a single quarter turn of the circular span of the discs 58, 60 causes the present invention to differ from drum-type winches where traction is due to the wrapping of one or more coils around a drum. The advantage of the present invention is that engagement of the well pipe 62 with the discs 58, 60 can be controlled by applying moderate hand pressure to raise or lower the well pipe 62 at the place 89 where it lifts off of the discs 58, 60. This reduces the number of circular degrees of engagement that exists. To immediately terminate the lifting action, the pipe 62 need merely be raised sufficiently by hand to release the grasping engagement.

Figure 2:
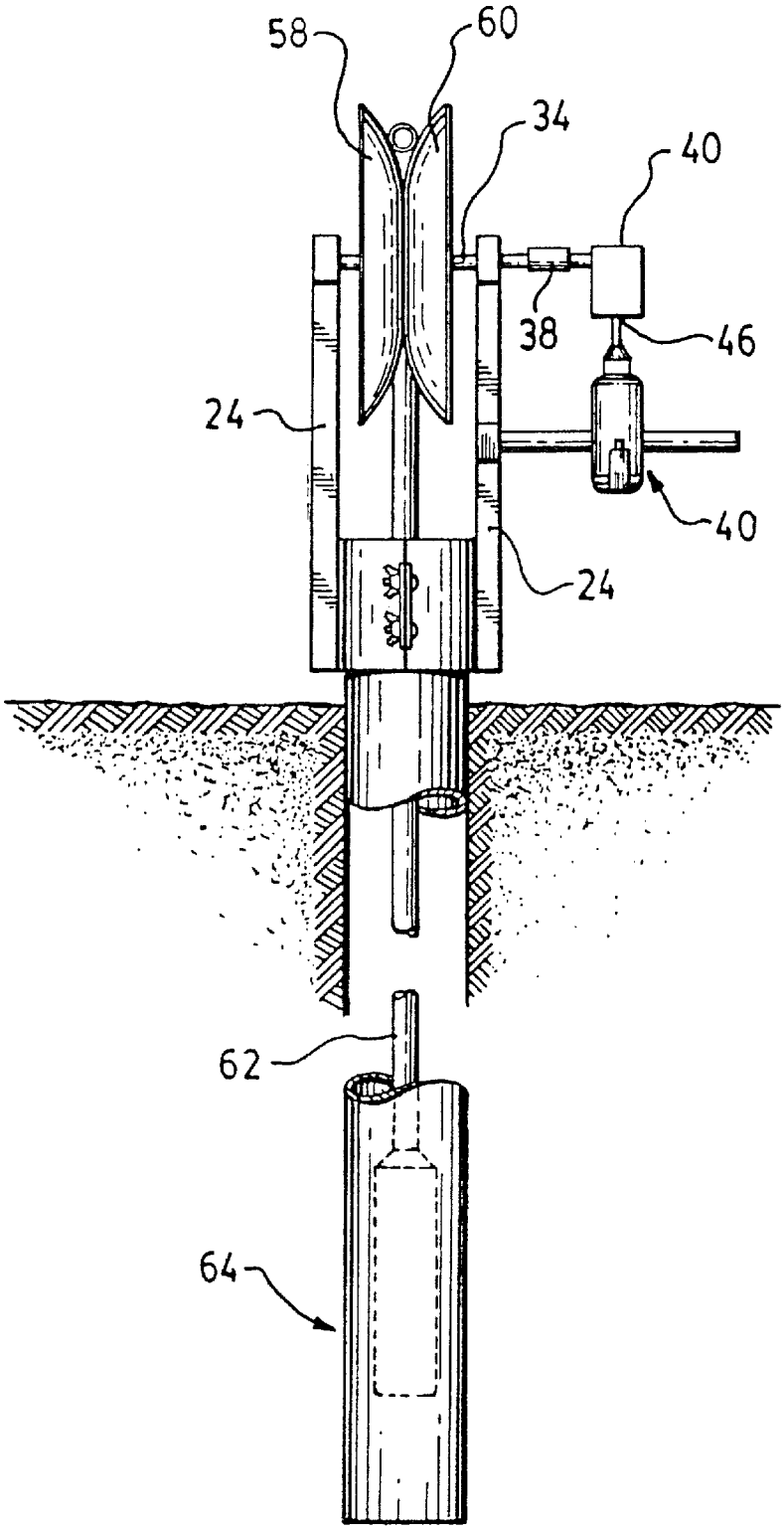
FIG. 2 is a side view of the apparatus of FIG. 1.

The discs 58, 60 may be in contact with each other along their inner portions 90 where they meet the axle. Or they may be truncated to contact each other at a larger radius 91, as shown in FIG. 2. Thus the discs need not be shaped in the manner described all the way to the axle, but need only taper towards, each other sufficiently to provide a gap that will grasp the size of pipe with which the winch is to be used.

Conclusion

The foregoing has constituted a description of specific embodiments showing how the invention may be applied and put into use. These embodiments are only exemplary. The invention in its broadest, and more specific aspects, is further described and defined in the claims which now follow.

The embodiments of the invention in which an exclusive property or privilege is claimed are defined as follows:

1. A portable apparatus for pulling flexible well pipe upwardly from within a well, comprising, in combination with flexible well pipe extending outwardly from a well:

(1) well pipe hoisting means comprising, opposed, circular discs carried on an axle, each of said discs having convex, pipe-engaging surfaces frictionally engaged with said flexible well pipe;

(2) actuation means for rotationally actuating the hoisting means in order to hoist the well pipe from the well; and (3) mounting means for mounting the hoisting means and the actuation means over the well wherein said flexible well pipe is bent between and wrapped over the convex, pipe-engaging surfaces to be frictionally engaged therewith and thereby pulled upwardly by the hoisting means upon actuation of the actuation means, said well pipe being manually disengageable from said pipe-engaging surfaces by the manual elevation of the portion of well pipe remote from the well.

2. A portable well pipe pulling apparatus in combination with flexible well pipe, said apparatus comprising:

(1) well pipe hoisting means incorporating a pair of mutually opposed, circular, inwardly tapering, rotatable, pipe-engaging surfaces carried on a pair of opposed discs supported on an axle;

(2) actuation means for rotationally actuating the pipe-engaging surfaces in order to hoist the well pipe from the well; and (3) mounting means for mounting the hoisting means and the actuation means over the well said well pipe being positioned between the pipe-engaging surfaces to effect frictional engagement therewith over a position of the pipe-engaging surfaces that corresponds to the pipe being bent over substantially one-quarter of a rotation of such surfaces said well pipe being manually disengageable from such pipe-engaging surfaces by the manual elevation of the portion of well pipe remote from the well.

3. The apparatus of claims 1 or 2 wherein the actuation means comprises a reduction gear box provided with coupling means for coupling the gear box to a portable hand drill.

4. An apparatus as in claim 3 wherein the well pipe is in contact with the pipe-engaging surfaces over substantially one quarter of the circular span of such pipe-engaging surfaces while the well pipe hoisting means draws the well pipe from the well.

5. An apparatus as in claims 1 or 2 wherein the opposed, pipe-engaging surfaces are in contact with each other at a distance spaced from the axle.

6. An apparatus as in claims 1 or 2 wherein the opposed pipe-engaging surfaces are in juxtaposition with each other where the discs are mounted on the axle.

7. An apparatus as in claims 1 or 2 wherein the mutually opposed, pipe-engaging surfaces are exposed both upwardly and on the side facing the well so that a middle portion of the well pipe may be directly laid between the pipe-engaging surfaces for engagement therebetween.

8. A method of removing flexible well pipe from a well over which is installed a portable apparatus comprising:

(1) well pipe hoisting means in the form of twin, opposed, circular discs carried on an axle, earth of such discs having convex, pipe-engaging surfaces for frictionally engaging flexible well pipe extending outwardly from a well;

(2) actuation means for rotationally actuating the hoisting means in order to hoist the well pipe from the well; and (3) mounting means for mounting the hoisting means and the actuation means over the well said method comprising the steps of laying well pipe between said pipe-engaging surfaces over a portion of the circular span of such pipe-engaging surfaces while said well pipe hoisting means draws the well pipe from a well, and controlling the engagement of the well pipe with the pipe-engaging surfaces by manually raising and lowering the well pipe on the side of the apparatus remote from the well.

9. A method of removing flexible well pipe from a well over which is installed a portable apparatus comprising:

(1) well pipe hoisting means having a pair of mutually opposed, circular discs carried on an axle, each of such discs having inwardly tapering pipe-engaging surfaces for frictionally engaging flexible well pipe extending outwardly from a well;

(2) actuation means for rotationally actuating the hoisting means in order to hoist the well pipe from the well; and (3) mounting means for mounting the hoisting means and the actuation means over the well said method comprising the steps of laying well pipe between said pipe-engaging surfaces over a portion of the circular span of such pipe-engaging surfaces while said well pipe hoisting means draws the well pipe from a well, and controlling the engagement of the well pipe with the pipe-engaging surfaces by manually raising and lowering the well pipe on the side of the apparatus remote from the well.

* * * * *